US005410783A

United States Patent [19]

Stoelinga

[11] Patent Number: 5,410,783

[45] Date of Patent: May 2, 1995

[54] CLAMP FOR LEAF OF SHEET SHAPED PRODUCTS

[75] Inventor: Titus A. Stoelinga, Arnhem, Netherlands

[73] Assignee: Enrico Leliveld, Arnhem, Netherlands

[21] Appl. No.: 175,752

[22] Filed: Dec. 30, 1993

[30] Foreign Application Priority Data

Jan. 4, 1993 [NL] Netherlands ..... 9300002

[51] Int. Cl.[6] ..... A44B 21/00

[52] U.S. Cl. ..... 24/516; 24/511

[58] Field of Search ..... 24/516, 515, 514, 500, 24/499, 511, 501, 67.7, 498

[56] References Cited

U.S. PATENT DOCUMENTS

| | | | |
|---|---|---|---|
| 630,034 | 8/1899 | Clark | 24/516 |
| 736,170 | 8/1903 | Stuver | 24/516 |
| 881,372 | 3/1908 | Buchanan | 24/516 |
| 1,070,403 | 8/1913 | Bryant | 24/511 |
| 1,074,605 | 10/1913 | Carter | 24/516 |
| 1,336,129 | 4/1920 | Cass et al. . | |
| 1,438,355 | 12/1922 | Bechstein et al. . | |
| 1,910,003 | 5/1933 | De Land . | |
| 2,461,083 | 2/1949 | Rank | 24/516 |
| 2,538,509 | 1/1951 | Dorner . | |
| 2,566,465 | 9/1951 | Robbins . | |
| 2,863,202 | 12/1958 | Hanna . | |
| 3,531,835 | 10/1970 | Paikin | 24/516 |
| 3,891,093 | 6/1975 | Petrie . | |
| 5,075,935 | 12/1991 | Abdi | 24/511 |

FOREIGN PATENT DOCUMENTS 2457403 12/1980 France .

*Primary Examiner*—Victor N. Sakran
*Attorney, Agent, or Firm*—Larson and Taylor

[57] ABSTRACT

Clamp for clamping one or more sheet shaped products in particular for bundling a small stack of papers. The clamp has a clamp opening (3,9) that by means of an operating member (11, 12, 13) can be brought into a clamping position (FIG. 2), the operating member passing a dead center. An elastic strip (10) bent into a U-shape, with built-up edges, can be inserted into the clamp opening, keeping the clamp opening (3,9) open when in the releasing position and serving as a gripping surface of a small stack of papers, in the position preventing the removal of the operating member (11, 12,13).

9 Claims, 2 Drawing Sheets

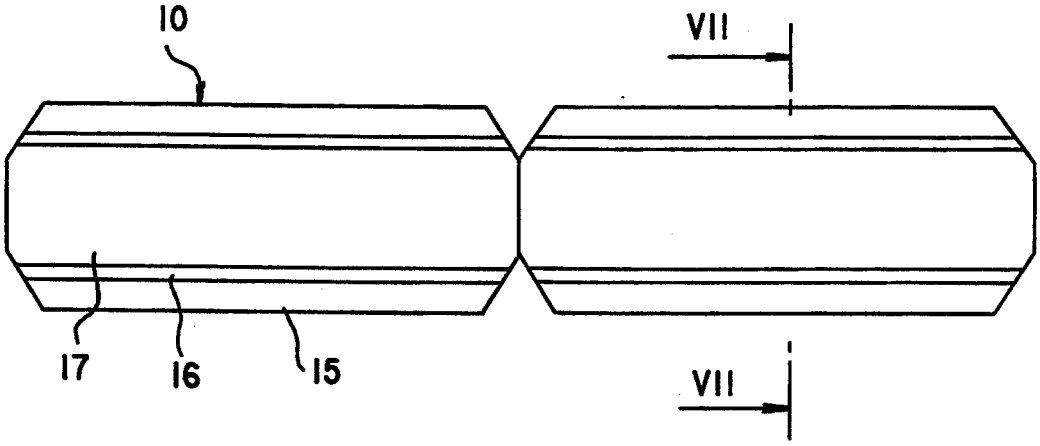
FIG.6
FIG.7
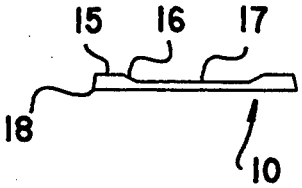
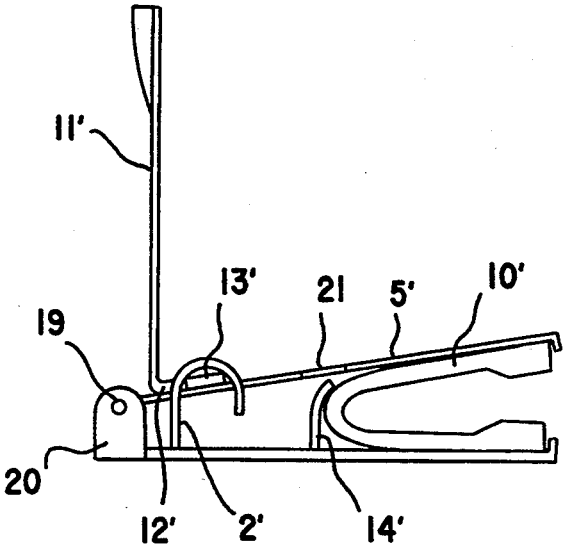
FIG.8

CLAMP FOR LEAF OF SHEET SHAPED PRODUCTS

The invention relates to a clamp for leaf or sheet shaped products, comprising a base plate, a clamping plate rotatably attached thereon, an operating member capable of carrying out a movement from a first position in which it allows the clamping plate with at any rate one edge to be remote from the base plate, and a second position in which it presses the clamping plate with at any rate at said edge against the base plate, in which movement a dead centre is passed causing the second position to be stable, spring means being present to keep the clamping plate distant from the base plate.

Such a clamp is known from the American patent U.S. Pat. No. 2,863,202. In this known clamp the resilient means are formed by a metal joint of the base plate and the clamping plate that constitute an entity. Said joint causes the opening of the clamp when the operating member does not exert pressure on the clamping plate, but when this is indeed the case, the clamping plate is moved downward with its free end. The pressure that can be exerted, however, is slight, because although the operating member may press the clamping plate down, it is elastically mounted, so that the hold-down force may decrease due to the yielding of said elastic joint.

A further disadvantage of said known clamp is that the combination of base plate and clamping plate constitute a fairly complicated entity, which has a relatively high cost price.

The invention aims at removing the aforementioned disadvantages and at providing a clamp that can be manufactured more economically, can offer a greater clamping force with materials of the same strength and has a better grasp of leaf or sheet shaped products.

The aforementioned aims are achieved in accordance with the invention by providing that the spring means are constituted by a strip bent into a U-shape made of elastic material, the legs of which lie with the outsides against respectively the base plate and the clamping plate, the insides of the legs constituting gripping surfaces for the products to be clamped.

According to a further elaboration of the invention it is preferably provided that the base plate and the clamping plate have bendings at said edges, which lie against the ends of the legs of the strip bent into a U-shape. Said edges provide that the elastic strip bent into a U-form is retained, and consequently have a different function than the ends of the clamping plate which are somewhat bent towards the clamp opening, as indicated in the American patent specifications U.S. Pat. No.2,566,465 and U.S. Pat. No. 2,863,202.

In applying the invention it is important that the strip of elastic material cannot be pushed backward by the leaf or sheet shaped products inserted, as a correct positioning of the different leaf or sheet shaped products often is important. In the American patent specification U.S.Pat. No. 2,863,202 such a limitation of the space into which the leaf or sheet shaped product can be inserted is accomplished by means of members cooperating with the operating member. It may, however, be desired to establish another value for the margin over which the products to be clamped are inserted into the clamp, thus preventing the U-shaped strip from being pushed backward. Accordingly it is provided in accordance with a further elaboration of the invention that stopping members are attached to the base plate and/or clamping plate to fix the place of the backside of the strip of elastic material.

An advantageous embodiment of the invention, which has been observed in practice to be satisfactory, is described in detail hereinbelow. In this respect it is pointed out that from the American patent specification U.S. Pat. No. 2,863,202 a rotatable connecting construction between the base plate and operating member has already been known, while the American patent specification U.S. Pat. No. 2,566,465 describes a rotatable connecting construction between the base plate and the clamping plate, which, however, also must convey the spring force which enables the clamp to be closed. In addition, there is also a pivoting construction between the clamping plate and the operating member, which in this case, however, does not pass a dead centre.

According to a simple embodiment construction of the invention it is provided that the operating member is rotatably mounted in lips extending from the base plate. In this respect it is pointed out that the latter characteristic is known per se from the American patent specification U.S. Pat. No. 2,863,202, but that in applying the invention, where the elastic strip in the open position constantly exerts upward pressure on the clamping plate, the clamp is prevented from disintegrating, due to the connecting part of the clamping plate leaving the open loop of the bent lips.

When in the invention the operating member comprises two legs enclosing an angle slightly smaller than 90°, for example 70°–85°, it is possible to bring said member in the closed position direct along the clamping plate and, moreover, to decrease the distance between said closed position and the dead centre.

A clamp in accordance with the invention can very easily be entered into the known files by simply punching holes therein that correspond to the clamping brackets of the files.

The invention will hereinafter be explained, reference being made to the drawings, where:

FIG. 1 schematically shows an enlarged side view of a clamp according to the invention in its open position;

FIG. 6 shows a view of a strip of elastic material when applied in the invention;

FIG. 7 shows a cross section of same strip of elastic material, and

FIG. 8 shows another embodiment of the invention,

Figure 1:
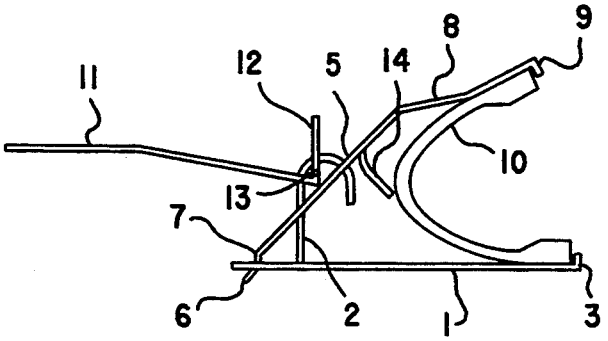
Figure 2:
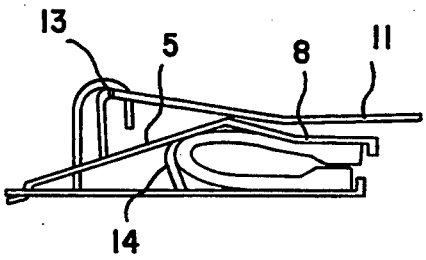
FIG. 2 shows the same in the closed position of said clamp.
Figure 3:
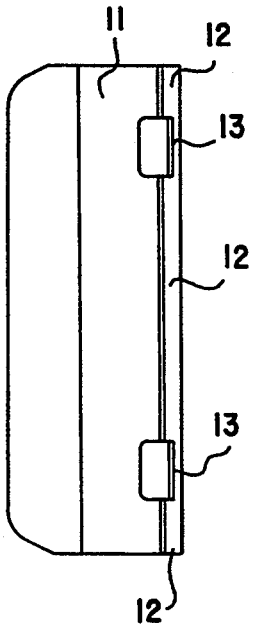
FIGS. 3,4 and 5 are full-sized top views of respectively the operating member, the clamping plate, and the base plate.
Figure 4:
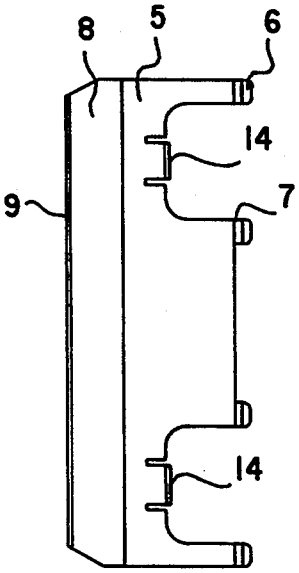
Figure 5:
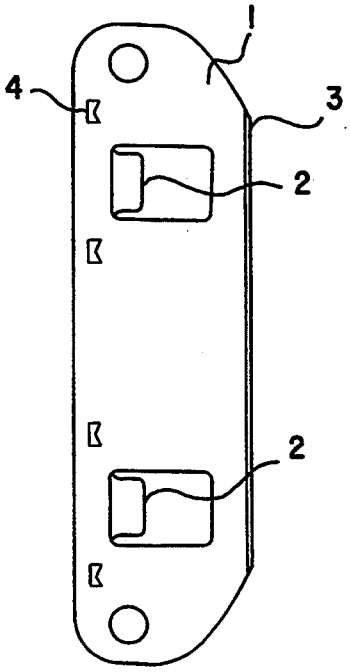

In FIGS. 1 and 2 a base plate is indicated by 1 with upright lips having ends bent back 2, a bent end edge 3 and openings 4 (see FIG. 5). Into the openings 4 a clamping plate 5 is inserted by means of lips 6 which at 7 have been bent once and then have been bent back. The clamping plate has a curve and the part located beyond 8 has a downward directed bent edge 9. An elastic spring member bent into a U-shape 10 provides that the part 8 is kept distant from the plate 1.

In the bend of the lips 2 an operating member 11 with a connecting part 12, situated in an angle slightly smaller than 90° thereto, is attached by means of a shaft part 13, that has remained when stamping the parts 11 and 12, and which serves as a shaft, the bent back lips 2 being bearings.

As can be observed in FIG. 2, after the rotation of the manually graspable portion 11 of the operating member, the end of the hook lever 12 will come into contact with the clamping plate 5 and will push it downward. The elasticity of the clamping plate 5, which may be for instance of spring steel, allows for a relatively wide opening between the parts 3 and 9 of the clamp.

The clamp, drawn so far, is easy to assemble by inserting the lips 6,7 into the holes 4 and then bending them towards the clamping plate 5,8, until the position as shown in FIG. 2 has been achieved. Subsequently the shaft part 13, which has remained upright in the operating member, can be brought underneath the curved part of the lips 2 . When now the folded strip member 10 is introduced, it prevents the shaft parts 13 from leaving the bent lips 2, likewise preventing the part 5 of the clamping plate from ending up in such a steep angle with the base plate 1, that removal is possible.

The clamping plate 5,8 further comprises bent parts 14, which constitute stopping members for the elastic strip bent into a U-form 10.

In the FIGS. 6 and 7 a view and a larger scale cross section are shown of a strip of elastic material from which the elastic U-shaped spring members 10 can be cut. Said strip has at its edges parts 15 with the largest thickness, which via tapering parts 16 convert into a central part 17 with the smallest thickness. The raised wall 18 leans from the bottom upwards slightly inward, which facilitates the insertion of the strip 10 between base plate 1 and clamping plate 5,8.

Another embodiment of the invention is shown in FIG. 8. In FIG. 8 the same components as in FIGS. 1 and 2 are indicated by the same references, provided, however, with a prime.

The clamping plate 5' is attached to a lip 20 by means of a pivoting construction 19. On said plate the arm 12' rests together with a projection 13' of the operating member 11', 12'. When now said member is rotated clockwise, 13' will move the plate 5' downward, as a result of which the clamp will be closed. Further penetration of the leaf or sheet shaped product is prevented by stops 14', which can stick into the openings 21 when the clamp is completely closed.

The clamp described is capable of satisfactorily securing one single sheet of paper as well as a stack having a thickness of 1 cm. When clamping a thick stack, the thicker edges of the elastic spring member 10 may be slightly compressed, which causes the pressure of the bent lips 2 to decrease at the dead centre and deformation or breaking of said lips to be prevented.

The clamp in accordance with the invention can be used not only in files, European as well as American ones with respectively two and three sets of bracket parts, but also for holding together of other stacks of leaf or sheet shaped material, such as photos, bank notes and the like, while on the one hand the rubber edges protect the product and on the other hand the clamp in closed position has a slight thickness of its own.

I claim:

1. A clamp for leaf or sheet shaped products, comprising:

a base plate;

a clamping plate having an edge;

a pivoting means for pivotally connecting said base plate and said clamping plate for movement of said edge toward and away from said base plate;

an operating member which engages said clamping plate and which is movable between a first position in which said edge of said clamping plate is remote from said base plate and a second position in which said edge of said clamping plate is pressed against said base plate, the movement of said operating member from said first position to said second position passing a dead center whereby the second position is stable; and a spring means for urging said clamping plate away from said base plate, said spring means being a strip bent into a U-shape so as to have first and second leg portions and being made from an elastic material, said first and second leg portions having (a) first and second outsides which lie against said base plate and said clamping plate respectively and (b) first and second insides which serve as gripping surfaces for the products to be clamped when said operating member is in the second position.

2. A clamp as claimed in claim 1, wherein said edge of said clamping plate is bent to form a bent edge, wherein said base plate includes a bent edge, and wherein said leg portions each have a free end which respectively engage a respective bent edge of said base plate and said clamping plate.

3. A clamp as claimed in claim 1, wherein said strip also includes a bent portion connecting said leg portions; and further including a stopping member attached to one of said base plate or said clamping plate which engages said bent portion of said strip to hold said strip in place between said base plate and said clamping plate.

4. A clamp as claimed in claim 1, wherein said pivoting means for pivotally connecting said base plate and said clamping plate is located at an end portion of said clamping plate distal from said edge; further including a connection means for pivotally connecting said operating member to said base plate; wherein said operating member comprises a first leg and a second leg attached to said first leg so as to enclose an angle, said first leg being manually graspable and longer than said second leg; and wherein said second leg is situated distant from said pivoting means but considerably closer to said pivoting means than to said edge of said clamping plate and presses on said clamping plate when said operating member is in the second position.

5. A clamp as claimed in claim 4, wherein the angle enclosed by said legs is less than 90°.

6. A clamp as claimed in claim 5, wherein the angle enclosed by said legs is 70°–85°.

7. A clamp as claimed in claim 4, wherein said pivoting means includes openings in one of said base plate or said clamping plate and twice bent lips extending from the other of said base plate or said clamping plate through said openings.

8. A clamp as claimed in claim 1, and further including a connection means for rotatably connecting said operating member to said base plate, said connection means including bent lips which extend from said base plate.

9. A clamp as claimed in claim 1, wherein said strip has a lateral cross section providing an edge part at each lateral side having a thickness, a central part having a thickness less than that of said edge parts, and a transitional part connecting a respective said edge part and said central part and having a gradually decreasing thickness from the respective said edge part to said central part.

* * * * *